United States Patent [19]

Holden

[11] Patent Number: 4,533,585

[45] Date of Patent: Aug. 6, 1985

[54] LIQUID HOLDING PACKAGING TRAY

[75] Inventor: M. James Holden, Canandaigua, N.Y.

[73] Assignee: Mobil Oil Corporation, N.Y.

[21] Appl. No.: 614,089

[22] Filed: May 25, 1984

[51] Int. Cl.[3] ..... B32B 3/12; B65D 1/34

[52] U.S. Cl. ..... 428/116; 220/DIG. 6; 229/2.5 R; 426/124; 426/129

[58] Field of Search ..... 428/116, 118, 117; 206/77.1; 220/DIG. 6; 229/2.5 R; 426/124, 129

[56] References Cited

U.S. PATENT DOCUMENTS

| | | | |
|---|---|---|---|
| D. 221,521 | 8/1971 | Crabtree | D9/425 |
| D. 268,568 | 4/1983 | Holden | D9/425 |
| 2,061,569 | 11/1936 | Fischer | 428/116 X |
| 2,974,843 | 3/1961 | Reifers et al. | 229/2.5 R |
| 3,233,885 | 2/1966 | Propst | 428/116 X |
| 3,346,400 | 10/1967 | Roesner | 403/401 |
| 3,450,326 | 6/1969 | Foote | 229/2.5 R |
| 3,488,081 | 1/1970 | Nolen | 428/116 X |
| 3,974,722 | 8/1976 | Florian | 426/129 X |
| 4,195,746 | 4/1980 | Cottrell | 428/118 X |
| 4,349,146 | 9/1982 | Holden | 229/2.5 R |
| 4,381,847 | 5/1983 | Bessett et al. | 229/2.5 R |

*Primary Examiner*—Henry F. Epstein
*Attorney, Agent, or Firm*—Alexander J. McKillop; Michael G. Gilman; Charles J. Speciale

[57] ABSTRACT

Disclosed is a packaging tray having a bottom construction which contains molded cells shaped and dimensioned to hold liquids by capillary action. The cells capture and retain liquids and prevent their free flow about the tray bottom. The bottom preferably also contains at least one upstanding raised area for holding foodstuffs away from the cells to prevent the foodstuff from breaking the surface tension of liquids retained in the cells, thus helping to ensure retention of liquids by the cells.

18 Claims, 9 Drawing Figures

LIQUID HOLDING PACKAGING TRAY

BACKGROUND OF THE INVENTION

1. Field of the Invention

The present invention relates to packaging trays for use in holding food items and, more particularly, relates to a molded packaging tray having a bottom configuration which holds liquids by capillary action, enabling use of the tray for transparent overwrap packaging of meat, poultry, fish and other liquid bearing comestibles.

2. Discussion of the Prior Art

In many modern food retailing operations, such as in supermarkets, meat and produce markets and the like, there are customarily employed food trays molded from wood or paper pulp or from various plastic material, for instance, foamed plastic, for the display and packaging of meats, fish, poultry and other produce or comestibles. Generally, these trays are relatively shallow rectangular flat-bottomed trays having outwardly inclined side walls, into which the commodities are placed, and thereafter a transparent material, such as heat sealable cellophane or heat shrinkable or stretchable plastic film, is tightly wrapped and sealed about the tray bottom to form an attractive retail package. This type of package is extremely neat in appearance, forms a protective arrangement for the commodity contained therein and allows prospective customers to view its contents, so as to greatly assist in the sale of the commodities.

Many commodities, such as meat, poultry and fish, which are packaged in this manner contain liquids which exude therefrom to the tray bottom, where they freely move, creating an unsightly appearance. When such trays are displayed in so-called "shingle stack" vertical arrangement, an unsightly liquid bead extends along the lower edge of the tray. The poultry industry in particular has attempted to remove the appearance of such liquids from packaged poultry products to improve product appearance.

In contemporary poultry processing operations, all poultry products are processed at a temperature of 28° F., which has become an industry standard. When poultry is cut, packaged, transported and displayed with this temperature maintained, the liquid within the poultry parts is frozen and thus entrained and does not exude out of the poultry parts into an associated packaging tray. At this temperature, the poultry itself, however, does not freeze and retains the "feel" and appearance of a fresh product. However, poultry is now typically cut and packaged by a central processor, who then ships the packaged poultry products many miles to a distribution location from which the product is then redistributed to local foodstores. This presents the opportunity, for example, during careless distribution or display, for the poultry product to rise above 32° F., at which point the liquids exude therefrom into the packaging tray. To combat this problem, poultry processors have begun placing absorption pads on the generally flat bottom of the packaging tray to absorb liquids. The absorption pad retains liquids therein, thereby improving product appearance. However, there are problems associated with the use of absorption pads.

Because the different poultry parts exude different amounts of liquid, e.g., drumsticks exude less liquid than breasts, a poultry processor must generally stock pads of different thicknesses and thus absorption capacities for each tray size which is used to package poultry products. A large stock of pads of differing thicknesses may therefore be required. In addition, the processor must employ additional workers or machinery to select and load pads of differing thickness into the trays, depending on the poultry parts to be packaged therein. Another problem with absorption pads is that it is impossible to fully utilize their absorption capacity because of the compression of the pad beneath the poultry parts, which occurs from the weight of the poultry and the tight overwrapping which occurs. Because of this loss of liquid retention ability, for a given amount of liquid to be absorbed, the pad must be thicker than would otherwise be required for liquid absorption.

The present invention is directed at minimizing problems associated with the use of absorption pads for absorbing liquids in the packaging of liquid bearing commodities.

SUMMARY OF THE INVENTION

One object of the invention is the provision of a packaging tray having a bottom construction capable of holding liquids thereon by capillary action, thus preventing such liquids from freely moving around the tray bottom and presenting an unsightly product appearance to a consumer.

Another object of the invention is the provision of a packaging tray having a bottom construction which can hold liquids thereon by capillary action and thus eliminate the use of an absorption pad for comestibles which exude a small to moderate amount of liquid, but which can also be used with absorption pads for comestibles which exude larger amounts of liquid.

Another object of the invention is the provision of a packaging tray having a bottom construction which can be used with or without absorption pads to retain liquids, which, when used with an absorption pad, enables the pad to use a greater amount of its non-compressed absorption capacity.

These and other objects are achieved by a packaging tray having a bottom formed with a plurality of spaced cells therein, each having a size which enables it to hold liquids by capillary action. Consequently, any liquid exuding from a comestible is held behind the foodstuff in the cells and is not free to move around the tray bottom where it would present an unsightly appearance. The cells are located at portions of the tray bottom which are typically below the comestible contained thereon so the retained liquid is not normally visible to a purchaser. A raised center and annular edge portions of the tray bottom assist in keeping the foodstuff away from the liquid retained in the cells to prevent the comestible from breaking the surface tension of the liquid in the cells which might cause it to freely flow along the tray bottom. Additional spaced, raised portions may also be provided, especially in larger sized trays, for this same purpose. The cells all have a uniform depth, except, in a preferred embodiment of the invention, predetermined numbers of rows of cells at locations adjacent the annular edge portion of the tray bottom have a gradually diminishing depth to improve bottom strength.

Other objects, advantages and structural features of the invention will become more clearly evident from the following detailed description of the invention, which is provided in connection with the accompanying drawings.

DETAILED DESCRIPTION OF THE INVENTION

Referring to FIGS. 1–3 and 5, a first embodiment of a packaging tray of the invention will be described. The packaging tray 11 of the invention is of a one-piece molded integral construction and has a plurality of side walls 13*a*, 13*b*, 13*c* and 13*d*, which are integrally connected at their longitudinal ends and which are connected at the bottoms thereof to a tray bottom 15. The one-piece tray construction illustrated is preferably molded of foamed plastic material, such as polystyrene foam, structural cellular polystyrene foam and other equivalent materials. The tray may even be constructed of solid plastic material, or of a pulp which is coated to make it liquid proof.

Figure 7A:
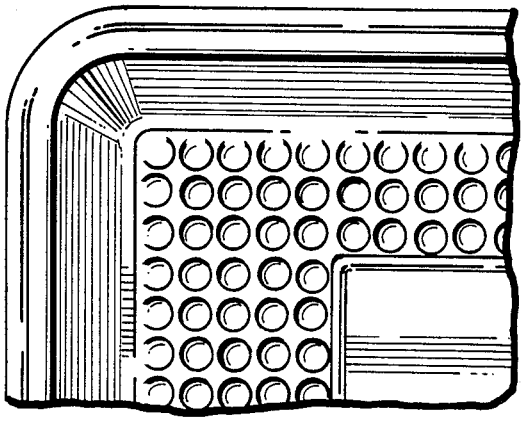
FIGS. 7A, 7B and 7C are top plan views of a portion of a packaging tray of the invention with modified cell constructions.
Figure 7B:
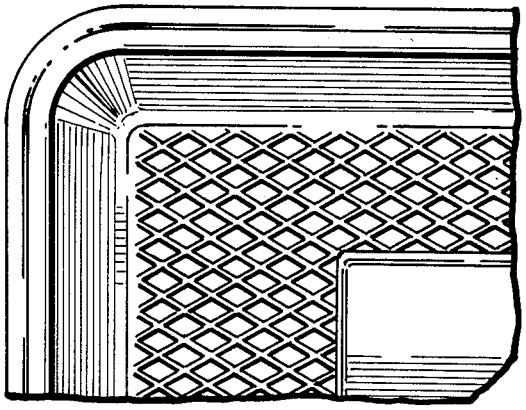
Figure 7C:
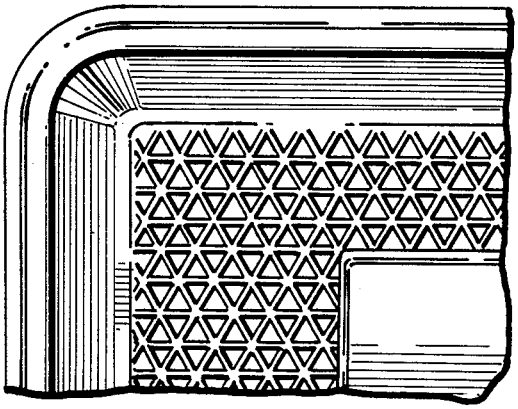

The packaging tray 11 is particularly adapted to entrain liquids on its bottom surface and prevent the free flow of such liquids along the tray bottom. To this end, the tray bottom 11 is provided with a plurality of depressions or cells 17 contained therein. The cells 17 are closely spaced about the tray bottom and, in the embodiment illustrated in FIGS. 1–3 and 5, are formed in regularly spaced rows and columns. The cells 17 are illustrated in greater detail in FIG. 5. Each has a bottom 39 and side walls 37 upstanding therefrom. The cells illustrated in FIGS. 1–3 and 5 have a square shape so that the side walls 37 intersect one another at raised areas 41, also referred hereinafter as "nubs". The top edges 43 of the side walls 37 have a downwardly curved saddle-like shape, as clearly seen in FIG. 5. Each of the cells 17 has a size which is capable of holding liquid as a bead therein by capillary action. The actual cell shape is not particularly critical to the invention. It can be rectangular, as shown in FIGS. 1–3 and 5, diamond shaped, as shown in FIG. 7B, triangular, as shown in FIG. 7C, or any other polygonal shape in plan view, or even round, as shown in FIG. 7A. The important aspect of the cell is that it not be of a size which is too large or too small to prevent a bead of liquid from being retained therein by capillary action. For square cells, bottom 39 should have a dimension on a side which is greater than approximately 0.05" and less than approximately 0.25". An exemplary suitable cell 17 has a square shape in plan view, and a square bottom 39 of approximately 0.1" on a side.

The cells 17 are preferably provided in areas of the tray which will underlie a packaged comestible, such as poultry parts. Thus, the liquid which is retained with the cells 17 is not directly viewable by a purchaser and any liquid exuded by the packaged comestible will thus be retained out of view and prevented from freely flowing about the bottom of the tray.

The capillary action provided by the cells 17 has a sufficient strength to prevent flow of liquids entrapped by the cells, even when the packaging tray is held substantially vertically, which occurs in the so-called "shingle-stack" type of display described above.

Because liquids are held in the cell 17 by capillary action, it is important, particularly when the cells are full of liquid, to minimize contact of any comestible with a liquid within the cell. Any such contact would disturb the surface tension of the liquid and facilitate its free flow about the tray bottom. To help minimize contact of a foodstuff with liquid retained in cells 17, a upstanding area 19 is provided preferably centrally of the tray bottom 15. Central upstanding area 19 has a height which is of a level higher than that of the upper level 23 of the cells 17, the upper level of the cells being defined by the highest point of nubs 41. With this arrangement a comestible lying on the tray bottom will be uplifted by upstanding area 19 and held away from any liquid entrapped within cells 17. To further assist in holding food products away from the upper levels of the cells, an annular peripheral area 27 is provided adjacent the bottom edges of the tray side walls 13*a*, 13*b*, 13*c* and 13*d*, which encircles the area of the tray bottom containing the cells. The annular peripheral area has a height which is substantially the same as that of the upstanding area 19 at the center of the tray. As a result, comestibles, particularly those that are somewhat rigid, can bridge across upstanding area 19 and annular peripheral area 27 and be held above the top level 23 of the cells and out of contact with any liquid contained therein. The raised nubs 41 also assist in maintaining a food product out of contact with liquids retained in the cells 17.

The tray bottom illustrated in FIGS. 1–3 and 5 also contains an annular well 29 surrounding central upstanding area 19 and also an annular raised area 31 surrounding well 29. The annular raised area 31 may be of the same height as upstanding area 19, or slightly less, to further assist in maintaining a comestible away from the top level of the cells 17. It should be apparent that well 29 need not be provided and that the upstanding areas 19 and 31 can be of the same height and blended together to effectively provide a larger upstanding area 19 than illustrated in FIGS. 1 and 2 or, more preferably, additional rows of cells may be provided in place of well 29 and raised area 31.

All cells 17 have a uniform depth of approximately 75 mils measured relative to level 23, except for those which are provided within two cell rows of the inner periphery 28 of the annular peripheral area 27. These two cells rows, as clearly illustrated in FIGS. 2 and 3, have bottoms which are raised in height with respect to the bottoms 39 of other cells of the tray. The bottom, for example, of cell 33, which is in the second cell row spaced from inner periphery 28, is slanted upwards and towards annular peripheral area 27. Likewise, cell 35 in the first cell row adjacent the inner periphery 28 has a higher elevation than that of the bottom of cells 33. The bottoms of both cells 33 and 35 are slanted at an incline of approximately 16° from the horizontal upwardly and towards inner periphery 28 of annular peripheral area 27. The rows of cells 33 and 35, which have upwardly tapering bottoms, are provided to strengthen the tray at the juncture of the outer peripheral row of cells at the tray bottom with the inner periphery 28 of the annular peripheral area 27. Although two cell rows are illustrated as having cells with upwardly sloping bottoms, tray strengthening can also be achieved with only one, or more than two, rows of cells with upwardly sloping bottoms adjacent inner periphery 28.

Exemplary dimensions for a 6"×8" packaging tray constructed in accordance with the invention and as illustrated in FIGS. 1–3 and 5 are as follows. The side walls 13*a* . . . 13*d* have a thickness of approximately 130 mils, while the upstanding area 19 and annular peripheral area 27 have a thickness of approximately 160 mils. The annular raised area 31 may also have a thickness of approximately 160 mils, but is typically less than that and is approximately 130 mils. The bottom thickness at nubs 41 is approximately 125 mils and the bottom thickness at the lowest point of the top edges 43 is approximately 95 mils. The thickness of the well bottoms 39 is approximately 50 mils.

Figure 1:
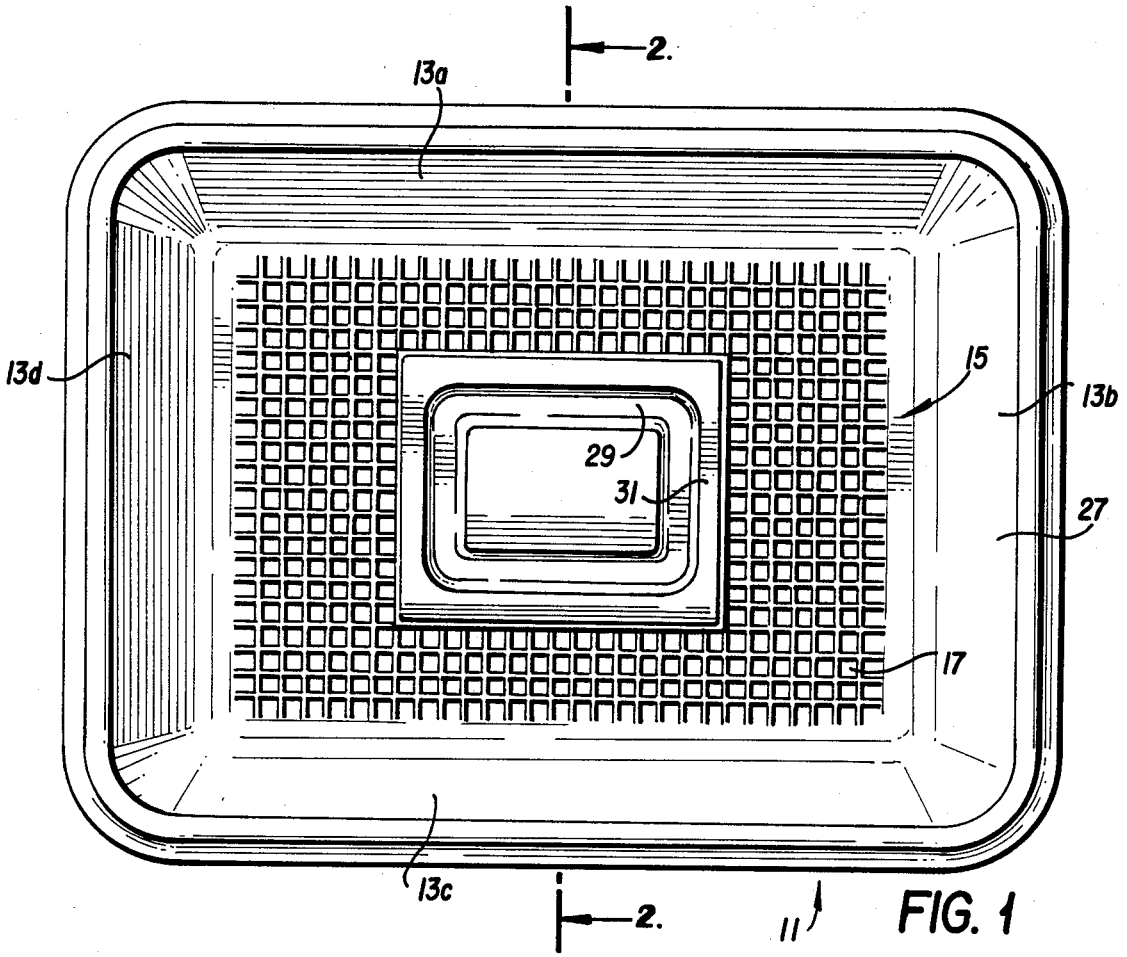
FIG. 1 is a top plan view of a packaging tray of the invention.
Figure 3:
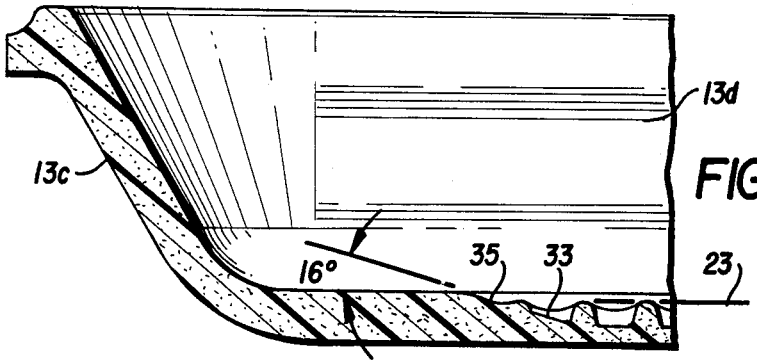
FIG. 3 is an enlargement of a portion of the sectional view of FIG. 2.

The cells 17 are preferably uniformly spaced about the tray bottom and, in the pattern illustrated in FIG. 1, the spacing is such that the distance between any point in a given cell to a corresponding point in an adjacent cell is approximately 0.2". However, the cells 17 need not be uniformly spaced about the tray bottom.

Figure 6:
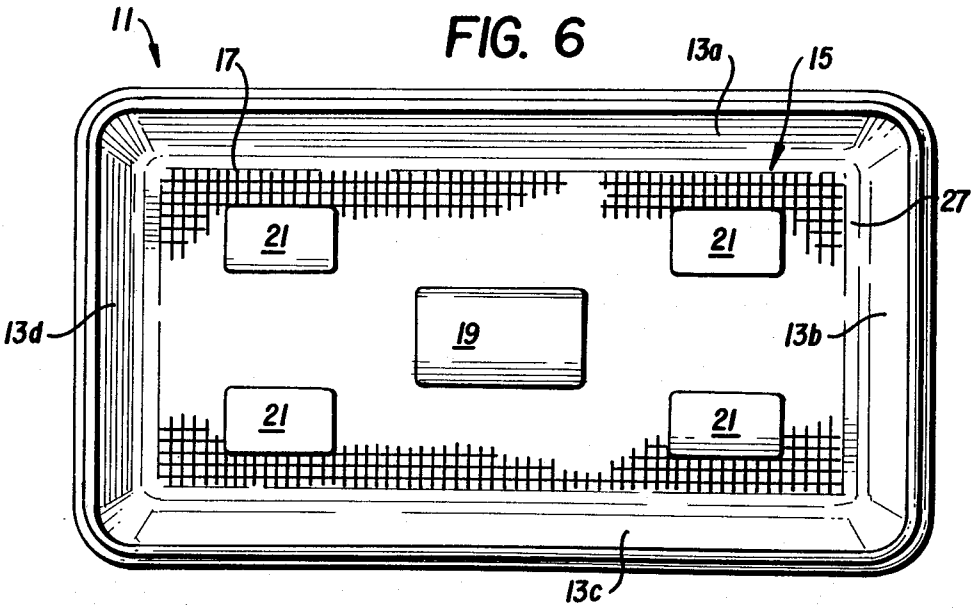
FIG. 6 is a top plan view showing a second modification of the invention.
Figure 5:
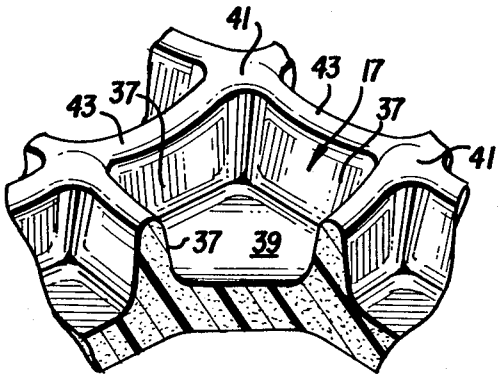
FIG. 5 is an enlarged detail view of a cell construction used in the invention.

Although the embodiment illustrated in FIGS. 1–3 and 5 contains a single central upstanding area 19, additional raised areas 21 may also be provided spaced throughout the tray bottom, as illustrated in FIG. 6. Each of the additional upstanding areas 21 has substantially the same height, at level 25 (FIG. 2), as that of central upstanding area 19. The additional spaced upstanding areas 21 are provided, particularly in larger trays, to ensure bridging over the cells by comestibles placed on the tray bottom. As illustrated in FIG. 6, the additional spaced upstanding areas 21 are typically surrounded by cells 17.

Figure 4:
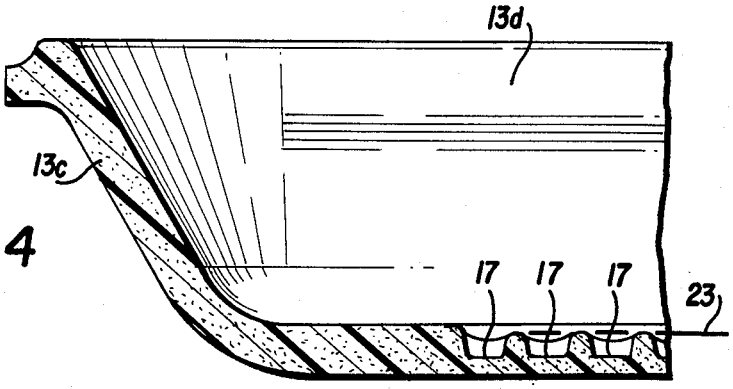
FIG. 4 is a view similar to FIG. 3, but showing a first modification of the invention.
Figure 2:
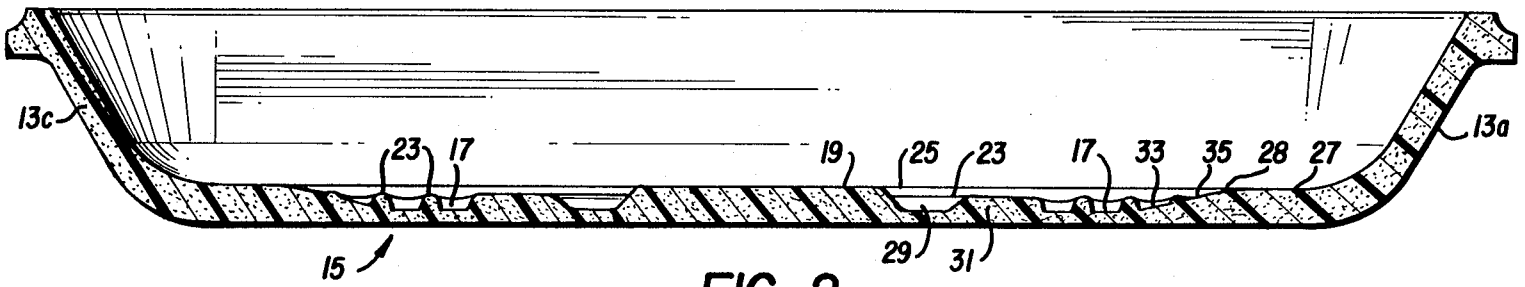
FIG. 2 is a sectional view along the lines 2—2 in FIG. 1.

FIG. 4 illustrates a modification to the embodiment of the invention illustrated in FIGS. 1–3 and 5. In this embodiment, all cells 17 have the same depth and bottom wall thickness. That is, there is no tapering upward of the bottom walls of the cells adjacent the inner periphery 28 of the annular peripheral area 27, as in the first described embodiment of the invention.

A packaging tray constructed in accordance with the invention will retain liquids by capillary action by means of cells 17 and, for comestibles which exude only a small amount of liquid, it can be used for packaging without requiring the presence of an absorption pad. For foodstuffs which exude larger amounts of liquids, the packaging tray of the invention can be used in conjunction with an absorption pad. When this is done, the cells do not serve to hold liquid by capillary action, but instead serve as areas where the pad may fit in and not be compressed. This effectively increases the absorption capacity of the pad as it decreases those areas of the pad subject to compression. In other words, an absorption pad having a smaller capacity can be used with the packaging tray of the invention than would be the case with a standard flat bottom tray. Thus, the packaging tray of the invention has advantages to a food processor, whether or not an absorption pad is used in connection therewith.

While preferred embodiments of the packaging tray of the invention have been illustrated, with particular reference to the accompanying drawings, it should be appreciated that many modifications can be made thereto without departing from the spirit and scope of the invention. Accordingly, the invention is not limited by the foregoing description, but is only limited by the scope of the claims appended hereto.

I claim:

1. A molded packaging tray comprising:

a generally rectangular bottom, and side walls extending upwardly from the periphery of said bottom, said side walls being of substantially the same height and integrally connected around the periphery of said bottom, said side walls and bottom being of an integrally molded construction, said bottom containing a plurality of liquid retaining cells having a size and configuration which enables said cells to retain liquids therein by capillary action, said bottom further containing at least one upstanding area having a height of a level which is greater than the level of the upper edges of said cells, said upstanding area assisting in maintaining a comestible above said upper edges of said cells.

2. A packaging tray as in claim 1, wherein said bottom further contains an annular peripheral area extending inward from said side walls towards a center of said tray bottom, said annular peripheral area having a height of a level which is greater than the level of said upper edges of said cells, said cells being located on said bottom within the inner periphery of said annular peripheral area.

3. A packaging tray as in claim 2, wherein the height level of said annular peripheral area is substantially the same as that of said one upstanding area.

4. A packaging tray as in claim 1, wherein one upstanding area is positioned centrally of said bottom.

5. A packaging tray as in claim 1, wherein said bottom contains a plurality of upstanding areas spaced about said bottom.

6. A packaging tray as in claim 5, wherein each of said upstanding areas is surrounded by said cells.

7. A packaging tray of claim 1, wherein each of said cells has the same depth.

8. A packaging tray as in claim 2, wherein each of said cells has the same depth except for cells within at least one cell row adjacent the inner periphery of said annular peripheral area, said cells within said at least one cell row having a depth which is less than that of cells outside said at least one cell row.

9. A packaging tray as in claim 8, wherein said cells each have a bottom disposed horizontally when said tray bottom is positioned horizontally, except for said cells within said at least one cell row which have bottoms sloping upwards and towards said inner periphery.

10. A packaging tray as in claim 9, wherein the slope of the bottoms of said cells within said at least one cell row adjacent said inner periphery is approximately 16°.

11. A packaging tray as in claim 1, wherein said cells have a polygonal shape in top plan view.

12. A packaging tray as in claim 11, wherein said cells have a rectangular shape in top plan view.

13. A packaging tray as in claim 12, wherein said cells have a square shape in top plan view.

14. A packaging tray as in claim 11, wherein said cells have a triangular shape in top plan view.

15. A packaging tray as in claim 11, wherein said cells have a diamond shape in top plan view.

16. A packaging tray as in claim 1, wherein said cells have a round shape in top plan view.

17. A packaging tray as in claim 1, wherein each of said cells is defined by a cell bottom and side walls upstanding from said bottom, the intersection of side walls from adjacent cells defining upstanding nubs which have a height of a level less than the height level of said upstanding area, top edges of said side walls between said nubs having a downwardly curved saddle-like shape.

18. A packaging tray as in claim 13, wherein said cells have square bottoms with a side edge thereof having a length greater than approximately 0.05" and less than approximately 0.25".

* * * * *